US008312698B2

(12) United States Patent
Munneke

(10) Patent No.: US 8,312,698 B2
(45) Date of Patent: Nov. 20, 2012

(54) ENVELOPE INSERTING APPARATUS

(75) Inventor: Christiaan Antoon Munneke, Drachten (NL)

(73) Assignee: Neopost Technologies, Bagneux (FR)

( * ) Notice: Subject to any disclaimer, the term of this patent is extended or adjusted under 35 U.S.C. 154(b) by 202 days.

(21) Appl. No.: 12/766,579

(22) Filed: Apr. 23, 2010

(65) Prior Publication Data

US 2010/0319300 A1 Dec. 23, 2010

(30) Foreign Application Priority Data

Apr. 24, 2009 (EP) ..... 09158754

(51) Int. Cl.
*B43M 3/04* (2006.01)
*B65H 9/16* (2006.01)

(52) U.S. Cl. ..... 53/493; 53/569; 53/381.6; 270/58.06; 271/227; 271/229

(58) Field of Classification Search ..... 53/51, 52, 53/493, 498, 500, 569, 284.3, 381.5–381.7; 270/58.06; 271/226, 229, 230, 243, 227; *B43M 3/00, 3/04*
See application file for complete search history.

(56) References Cited

U.S. PATENT DOCUMENTS

| | | | | |
|---|---|---|---|---|
| 2,839,880 | A * | 6/1958 | Boughton | 53/569 |
| 4,020,615 | A | 5/1977 | Irvine et al. | |
| 4,043,551 | A | 8/1977 | Morrison et al. | |
| 4,926,612 | A * | 5/1990 | Krasuski et al. | 53/284.3 |
| 5,100,125 | A | 3/1992 | Uplinger et al. | |
| 5,630,312 | A * | 5/1997 | Ballard et al. | 53/569 |
| 5,642,598 | A * | 7/1997 | Cannaverde | 53/284.3 |
| 5,740,663 | A * | 4/1998 | de Haan et al. | 53/569 |
| 5,755,437 | A * | 5/1998 | Ek | 271/230 |
| 6,367,794 | B1 * | 4/2002 | Godwin et al. | 270/58.26 |
| 2003/0020231 | A1 | 1/2003 | Williams et al. | |
| 2005/0034433 | A1 | 2/2005 | Gomez | |
| 2007/0157578 | A1 * | 7/2007 | Fairweather et al. | 53/284.3 |
| 2007/0164496 | A1 * | 7/2007 | Kapturowski et al. | 270/52.01 |

FOREIGN PATENT DOCUMENTS

| | | | |
|---|---|---|---|
| EP | 0 473 884 | A1 | 3/1992 |
| EP | 1 304 305 | A2 | 4/2003 |
| FR | 2 308 573 | A | 11/1976 |
| JP | 60118542 | A * | 6/1985 |
| JP | 01176751 | A * | 7/1989 |
| JP | 02051794 | A * | 2/1990 |
| WO | 02/26508 | A1 | 4/2002 |

* cited by examiner

*Primary Examiner* — Stephen F Gerrity
(74) *Attorney, Agent, or Firm* — Sughrue Mion, PLLC

(57) ABSTRACT

An inserting apparatus for inserting documents into envelopes comprising an envelope holder for holding an envelope in a document inserting position, wherein a first upstream end of the envelope is in an open position for receiving the document, a document displacement arrangement for displacing the document along a document inserting path into the envelope, wherein the apparatus further comprises a document steering arrangement arranged opposite to an envelope crease line provided between an envelope flap and an envelope body. The arrangement comprises steering elements spaced apart along a central axis that in use is substantially aligned with the envelope crease line. The steering elements are interconnected such that in use the respective steering elements are rotatable about the central axis in a similar direction with a similar speed during a similar time interval.

17 Claims, 4 Drawing Sheets

ENVELOPE INSERTING APPARATUS

FIELD AND BACKGROUND OF THE INVENTION

Figure 1:
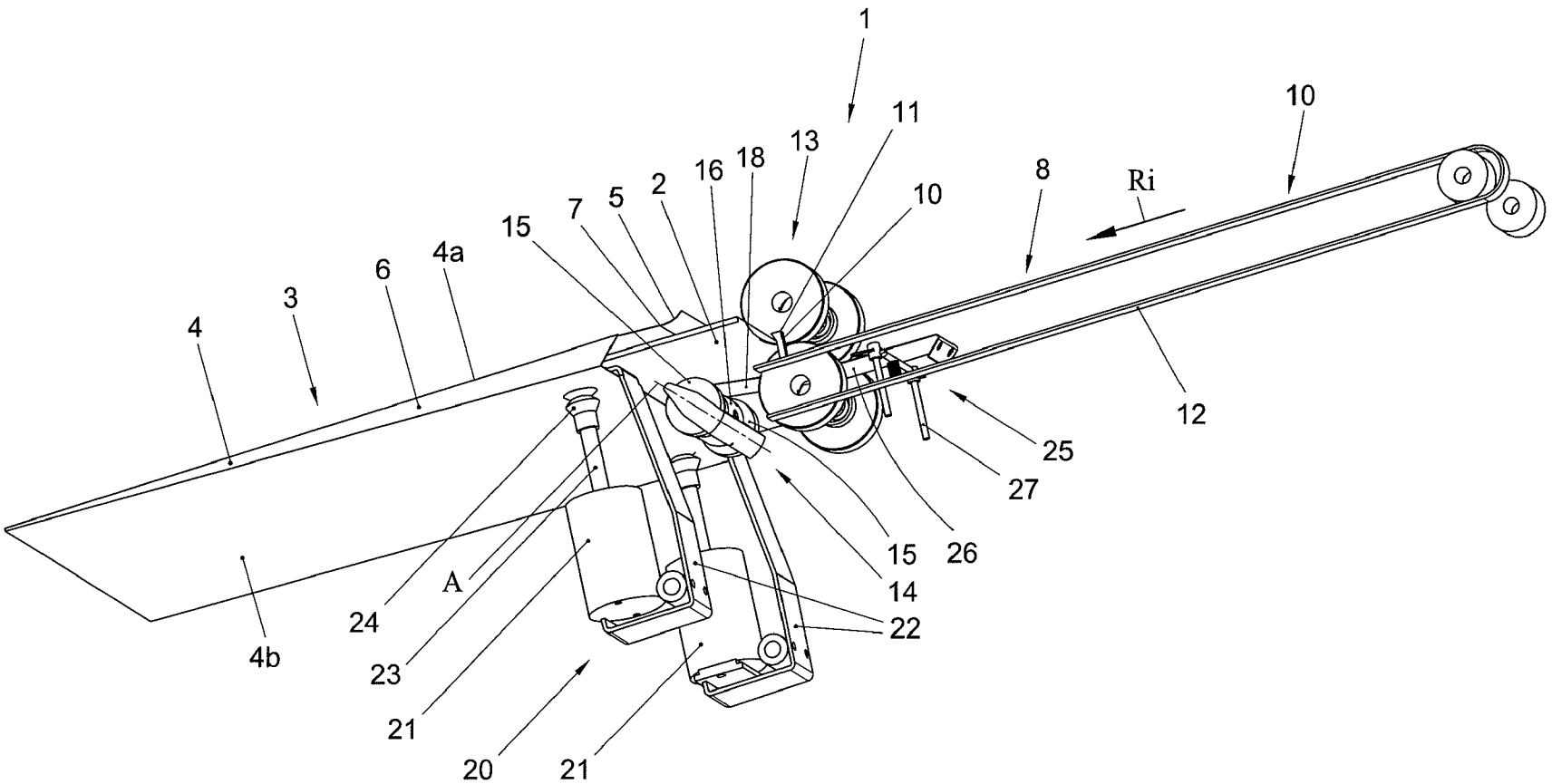

The invention relates to an inserting apparatus for inserting documents into envelopes.

Such an inserting apparatus is known from practice and may comprise an envelope holder for holding an envelope in a document inserting position and a document inserting path arranged upstream of the envelope holder for feeding at least one document to the envelope, which envelope at the moment of insertion is opened at a first upstream end thereof for receiving said document. The inserting apparatus may further comprise a document displacement arrangement for displacement of the document at least along the document inserting path into the envelope. Such a displacement arrangement comprises at least one displacement element that is adapted to push the document into the envelope. The inserting apparatus may comprise guiding elements arranged on both sides along the document inserting path to align the at least one document with the envelope in the inserting position.

However, at the moment the document or a set of documents is inserted in the envelope, the document may collide with an inner side of the envelope. On the one hand, such a collision may be the result of a displacement of the document with respect to the envelope before insertion, for instance due to friction of the document at one of the lateral sides of the document and for instance the guiding elements. On the other hand, such a collision may actually result in a displacement of the document with respect to the envelope before complete insertion of the document into the envelope. Due to the skew of the document relative to the envelope, the document may get stuck or get damaged resulting in obstruction of the envelope inserting process. For instance, a jam of documents may occur in the inserting apparatus. In that case time consuming operations may be necessary because the apparatus has to be stopped and the jam of documents has to be removed. This may result in a negative effect on overall productivity of such inserting apparatuses.

SUMMARY OF THE INVENTION

It is an object of the present invention to provide an envelope inserting apparatus for inserting documents into envelopes, wherein the document is prevented from rotating with respect to the envelope and/or is aligned with the envelope at least upon insertion of the document into the envelope.

In order to achieve the above mentioned object, an inserting apparatus for inserting documents into envelopes is provided, the apparatus comprising:

an envelope holder for holding an envelope at least in a document inserting position, wherein a first upstream end of the envelope is in an open position for receiving said document;

a document inserting path arranged upstream of the envelope holder for feeding at least one document to the envelope in a document inserting direction;

a document displacement arrangement for displacing the document at least along the document inserting path into the envelope;

wherein the document displacement arrangement comprises at least one displacement element that is adapted to push the document into the envelope, wherein the apparatus further comprises a document steering arrangement arranged upstream of the envelope holder such that the arrangement in use is substantially opposed to an envelope crease line provided between an envelope flap and an envelope body, which arrangement comprises at least two steering elements that are spaced apart along a steering arrangement central axis that in use is substantially aligned with the envelope crease line, which steering elements are interconnected such that in use said respective steering elements are rotatable about the central axis in a similar direction with a similar speed during a similar time interval.

Providing a document steering arrangement upstream of the envelope holder prevents rotation of the document with respect to the envelope due to collision of said document with the envelope. The arrangement further allows aligning of the document relative to the envelope at the latest possible moment before insertion of the document into the envelope. Thus, relative displacement of the document with respect to the envelope just before and during insertion is minimized resulting in a minimized risk of collision of the document with the envelope. The document steering arrangement is positioned opposite of an envelope crease line provided between an envelope flap and an envelope body when the envelope is in the document inserting position. Preferably, the envelope flap extends in an upstream direction from the envelope part of the envelope body facing away from the document steering arrangement. Upon displacement of the document by means of the document displacement arrangement, the document is displaced along the document inserting path towards the envelope. Before entering the envelope inner space, the document abuts with the steering elements of the document steering arrangement that are spaced apart along a steering arrangement central axis that in use is substantially aligned with the envelope crease line. When the document is aligned with the envelope in the envelope holder, the side of the document facing the envelope will abut with both steering elements approximately at the same moment in time. Due to the fact that the steering elements are interconnected, the steering elements start rotating about the central axis in a similar direction with a similar speed during a similar time interval resulting in a displacement of the document in the inserting direction. Due to the force that is applied by the steering elements to the document, the document is prevented from rotation and displacement upon contacting the envelope. In case the document is skewed with respect to the envelope before reaching the envelope, the document will abut with one of the steering elements first. Due to the friction applied to the document by the steering element as result of the initial rotation force of that steering element, the displacement in the inserting direction of part of the document facing said steering element is slowed down. Consequently, the document at least at the position of the second steering element is displaced such that it also abuts the second steering element. At that moment, the document is aligned and can be displaced by the steering elements as described above. Due to the fact that the steering elements are interconnected, both steering elements start rotating when at least one of the steering elements is rotated by the document that is contacting said steering element. The steering elements apply a force to the document that prevents the document from rotating just before inserting it into the envelope. Thus, the document steering arrangement may correct the position of the document with respect to the envelope and may keep the document in the aligned position. Consequently, inserting efficiency of the inserting apparatus is improved with a relatively simple arrangement that is provided upstream of the envelope holder.

It is noted that the term 'document' throughout this application should be interpreted in a broad way. The term document refers to at least one or more documents, magazines, books and other suitable inserts such as a CD, DVD or the like and any combination thereof.

According to a further aspect of the invention, the document displacement arrangement may comprise at least two pushing fingers that form the displacement elements, which pushing fingers are spaced apart and arranged transversely with respect to the document inserting path. When only one pushing finger is displacing the document along the inserting path because the document is in a slightly rotated position, the steering arrangement may align the document such that the side of the document facing the pushing fingers is pushed against both fingers resulting in an effective displacement of the document along the inserting path.

In order to be able to use envelopes with different kinds of dimensions, in particular with different widths, a distance between the respective steering elements may be smaller than a distance between the respective pushing fingers such that the steering elements are positioned between the inserting fingers in a direction substantially perpendicular to the document inserting path. It may be advantageous, according to a further aspect of the invention, if the distance between the respective steering elements is as large as possible. Thus, preferably the respective steering elements are positioned adjacent the respective pushing fingers. In order to prevent the document from buckling in a transversal direction, a support surface may be provided in the inserting apparatus between the respective steering elements to support a middle part of the document and thus prevent buckling of the document between the steering elements. This may increase the proper functioning of the document steering arrangement, for instance in case the document has a minimal thickness.

In a further advantageous embodiment of the invention, the inserting apparatus comprises lifting means arranged such that the document steering arrangement is liftable with respect to the document inserting path. By lifting the document steering arrangement, documents with a relatively large length in a direction substantially parallel to the inserting direction or documents that are sensitive to bending in said direction and that pass the document steering arrangement may be lifted such that buckling of the document between the document inserting arrangement and the document displacement arrangement is prevented. Preferably, the document is lifted at the moment the document starts running along the steering elements. This provides an inserting apparatus with increased operating efficiency for large documents as well.

According to a further aspect of the invention, the document steering elements may be drivable, for instance in reaction to a signal from a sensor, such as a position sensor, arranged in the apparatus for detecting of a document position, in order to actively rotate the respective steering elements. Such drivable steering elements may be arranged additionally to or instead of the lifting means. By driving the steering elements, buckling of the documents may be prevented further. Preferably, the steering elements may be driven at the moment the document has passed the steering elements and starts to enter the inner space of the envelope.

In order to be able to detect if the document is completely inserted into the envelope, the inserting apparatus may comprise a detection unit to detect the position of the document with respect to the envelope. In an embodiment of the invention, the detection unit may comprise an indicator rotatably arranged to the document steering arrangement and adapted to rotate during passing of a document and a sensor adapted to determine a displacement of the indicator.

Further embodiments of the inserting apparatus are set forth in the dependent claims. Further features, effects and details of the invention appear from the detailed description and the drawings.

BRIEF DESCRIPTIONS OF THE DRAWINGS

Figure 2:
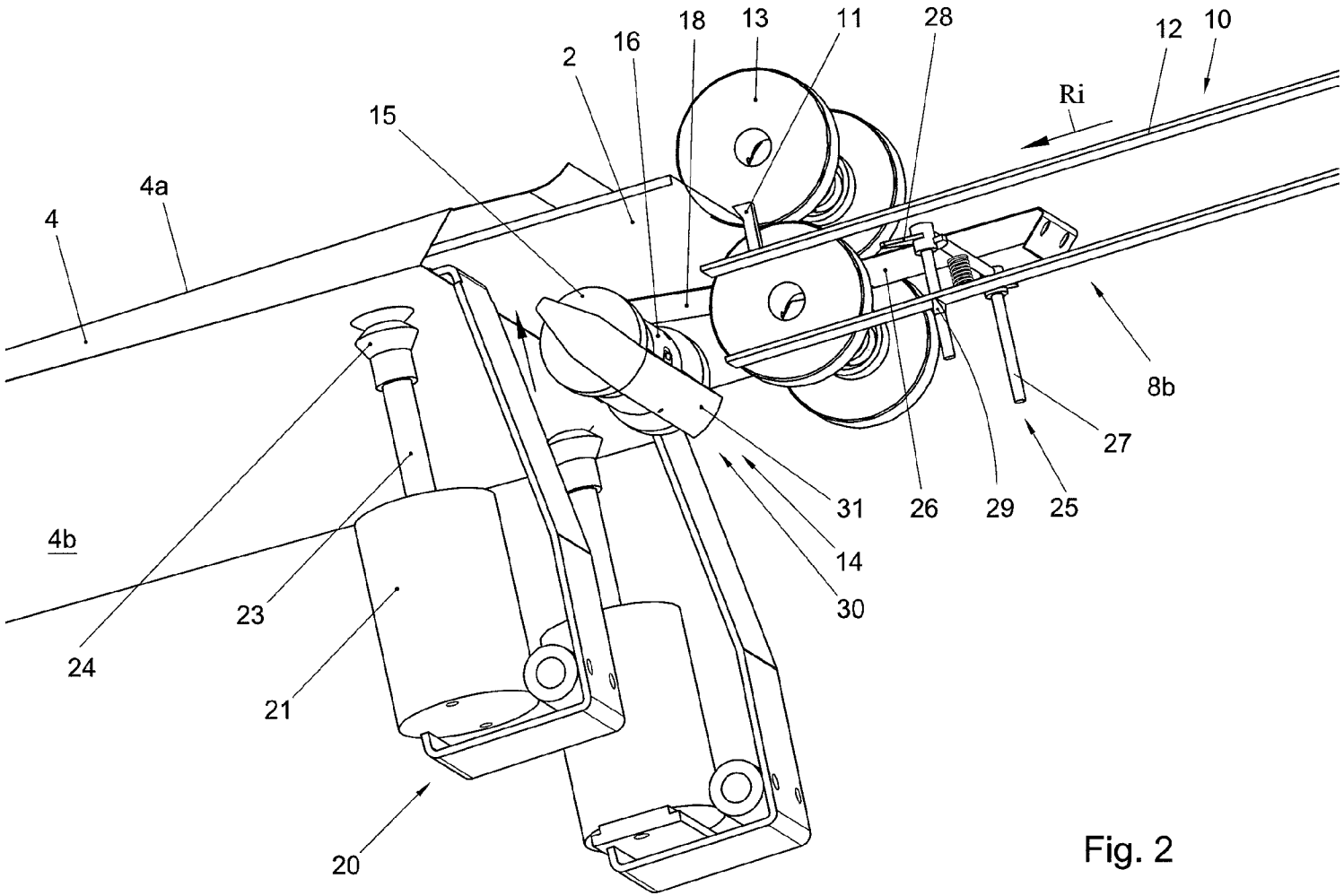
Figure 3:
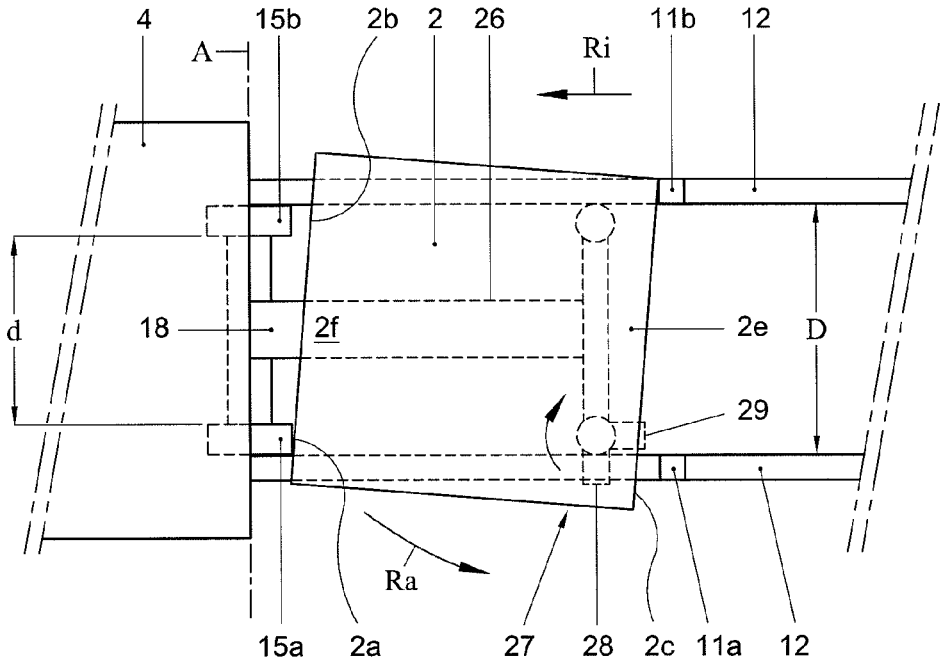
Figure 4:
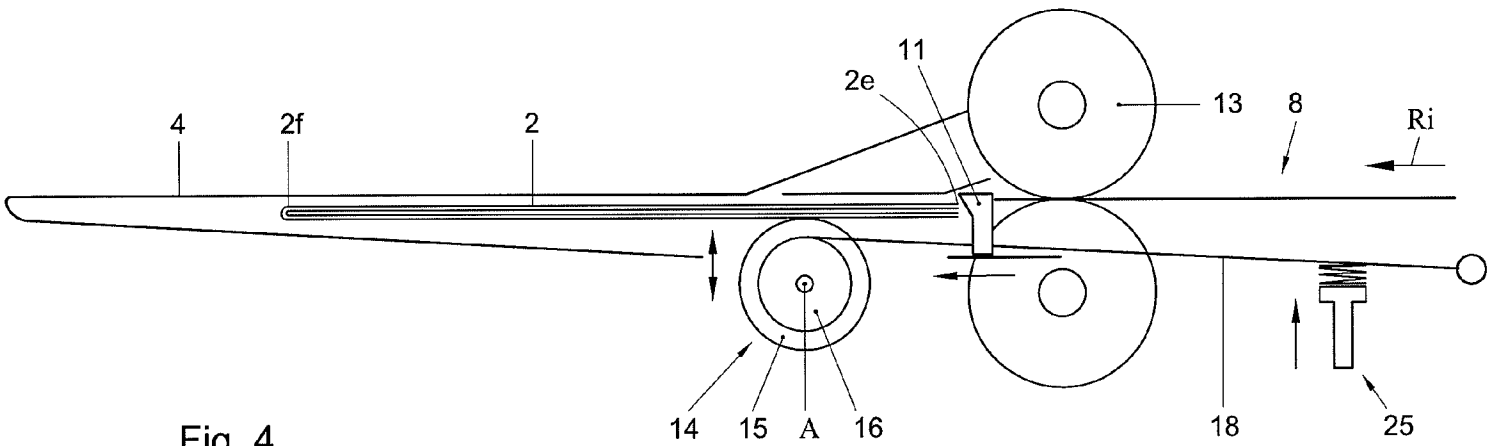
Figure 5:
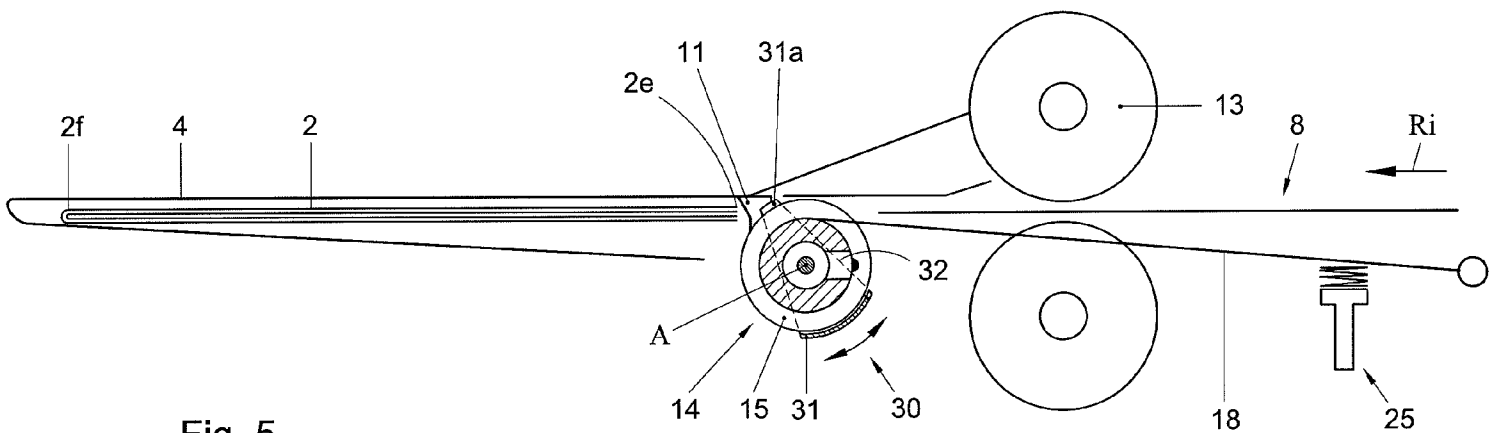

The invention will now be further elucidated by means of, non-limiting, examples referring to the drawing, in which:

FIG. 1 schematically shows a perspective view of an example of the inserting apparatus according to the invention;

FIG. 2 schematically shows a detail of the example of the inserting apparatus as shown in FIG. 1;

FIG. 3 schematically shows in top view an example of the inserting apparatus according to the invention;

FIG. 4 schematically shows in side view an example of the inserting apparatus according to the invention; and FIG. 5 schematically shows another side view of an example of the inserting apparatus according to the invention.

It is noted that identical or corresponding elements in the different drawings are indicated with identical or corresponding reference numerals.

DETAILED DESCRIPTION OF THE DRAWINGS

The inserting apparatus 1 for inserting documents 2 into envelopes 4 according to the example as shown in FIGS. 1-5 is first described with reference to FIG. 1.

The inserting apparatus 1 that is shown in FIG. 1 can be mounted on or be part of a system for processing documents, for instance downstream of a copying system or a printing system. The inserting apparatus 1 comprises an envelope holder 3 that holds the envelope 4 in the document inserting position as shown in FIG. 1. The envelope 4 can be fed to the envelope holder from an envelope storage along an envelope feeding path (not shown). Upstream of the envelope holder 3, a document inserting path 8 is arranged that in use feeds documents 2 to the envelope 4 that, at least the end of the envelope 4 facing the document inserting path 8, is in an open position. The inserting apparatus 1 further comprises a document displacement arrangement 10. The displacement arrangement 10 is arranged for displacing the document 2 along the inserting path 8 in the inserting direction Ri into the envelope 4. Therefore, the arrangement 10 comprises two displacement elements 11, in this example two pushing fingers 11 that are provided transversally relative to the document inserting path 8 and which are mutually spaced apart. Preferable, a distance D (see FIG. 3) between said pushing fingers 11 does not exceed approximately 120 mm such that the inserting apparatus 1 can be used for relatively small documents 2 for inserting into small envelopes 3 with an envelope width that does not exceed approximately 130 mm. The pushing fingers 11 are arranged on an endless belt 12 that is displaceable in the document inserting direction Ri. Adjacent the end of the document inserting path 8 facing the envelope holder 3, supplementary transporting rollers 13 are provided arranged such that in use a document 2 to be inserted passes between said transporting rollers 13. The inserting apparatus 1 further comprises a document steering arrangement 14. The document steering arrangement 14 is arranged upstream of the envelope holder 3. In use, the document steering arrangement 14 is located opposite to the envelope crease line 7, which is provided between the envelope flap 5 and the envelope body 6 of the envelope 4. When the envelope 4 is received in the envelope holder 3, the envelope flap 5 extends from an upper part 4*a* of the envelope 4 in a direction opposite to the inserting direction Ri.

The document steering arrangement 14 comprises two steering elements 15, in this example two rollers 15 that are spaced apart along a central axis A (see also FIG. 3) of the steering arrangement 14. In use, the crease line 7 of the envelope 4 is substantially aligned with the central axis A. The steering elements 15 are interconnected such that said steering elements 15 are rotatable about the central axis A in a similar rotational direction during a similar time interval. In different words, if one of the steering elements 15 starts rotating, the other one of the steering elements 15 starts rotating as well in the same direction with the same speed. The steering elements 15 are connected to an axle 16 that extends along the central axis A. The steering rollers 15 preferably have a diameter of approximately between 20-30 mm and are connected at mutual distance to the axle 16, wherein the distance d (see FIG. 3) between the respective rollers 15 preferably is as large as possible. The distance between the rollers 15, however, is smaller than the distance D between the respective pushing fingers 11, such that the rollers 15 are positioned between the inserting fingers 11 seen in a direction substantially perpendicular to the document inserting path 8. With such a construction of the document steering arrangement 14, the inserting apparatus 1 can be used for envelopes 4 having a relatively small width as explained before. To bring the envelope 4, or at least the upstream end thereof, in an open position (as for instance shown in FIGS. 1 and 2), the inserting apparatus 1 is also provided with an envelope opening device 20, that is adapted to open a throat of the envelope 4 before the document 2 to be inserted, reaches the envelope 4.

Referring now to FIGS. 1-3, operation of the inserting apparatus 1 according to the invention is described. The inserting apparatus 1 may be arranged downstream of a document collator (not shown) that collates an amount of documents 2 that are subsequently transported along the document inserting path 8 towards the inserting apparatus 1. The amount of documents 2 (for the sake of clarity further indicated as document 2) is pushed by means of the pushing fingers 11 in the inserting direction Ri. At the same time, an envelope 4 is fed to the envelope holder 3 and the flap 5 is opened such that the flap 5 extends from the upper part 4*a* of the envelope body 6. Preferably, the envelope 4 is held at the flap 5 in the envelope holder 3.

In the shown example, the envelope opening device 20 comprises two suction cylinders 21 and two hook elements 22 that are mechanically coupled to the respective suction cylinders 21. Preferably, the distance between the respective suction cylinders 21 can be adjusted to a width of the envelope 4. To open the envelope 4, the suction cylinder 21 is pushed against an outer surface of the lower part 4*b* of the envelope body 6, which is clearly shown in FIG. 2. By pushing the suction cylinder 21 against the envelope 4, the piston 23 is pushed into the cylinder 21 such that air from within the cylinder 21 leaves said cylinder 21 via a small non-return valve (not shown). At that moment, the hook element 22 is retracted. Subsequently, the cylinder 21 is moved in a direction away from the envelope 4, at the same time pushing the piston 23 out of the cylinder 21. The suction cup 24, that is located at the end of the piston 23 facing the envelope 4, is pushed against the envelope 4. A vacuum that is created in the suction cup 24 pulls the lower part 4*b* of the envelope body 6 from the upper part 4*a* of the envelope body 6 thereby opening the throat of the envelope 4. Then the hook element 22 is able to enter the throat of the envelope 4 to keep the throat in an open position after removal of the vacuum.

The pushing fingers 11 continue to push the document 2 towards the envelope 4 such that the document 2 passes the additional roller pairs 13 and subsequently reaches the document steering arrangement 14. Upon contacting the steering rollers 15 of the steering arrangement 14, the document 2 is subjected to a certain resistance provided by the steering rollers 15. The interaction of the document 2 with at least one of the steering rollers 15 results in rotation of the steering rollers 15. The steering arrangement 14 is arranged such that the steering elements 15 apply a press-on force of approximately 0.25-1 Newton to the envelope 4, at least to the envelope crease line 7. Due to this force, the document 2 is prevented from rotating just before and during insertion of the document 2 into the envelope 4. Furthermore, if the document 2 is skewed with respect to the envelope 4 before entering the envelope 4, the document steering arrangement 14 may correct the document alignment with respect to the alignment of the envelope. This will be explained now referring to FIG. 3.

If the skewed document 2 is pushed in the inserting direction Ri, a first part of the document 2, for instance in this example a first document corner 2*a* reaches the first steering roller 15*a* before the second steering roller 15*b* is reached by the document 2. When the first document corner 2*a* contacts the first steering roller 15*a*, the first steering roller 15*a* offers resistance to the first document corner 2*a* such that the displacement speed of the document locally decreases. Then the document 2 rotates in direction Ra resulting in displacement of the corner 2*c* of the document 2, that faces the first pushing finger 11*a*, towards said pushing finger 11*a*. Subsequently, when the pushing fingers 11 continue to displace the document 2, the document 2 is aligned with respect to the envelope 4 and stays aligned due to the press-on force of the document steering arrangement 14 as explained before. The press-on force may be applied to the envelope 4 by means of a leaf spring 18 that is provided between the document steering arrangement 14 and the inserting apparatus 1, as shown in FIGS. 1 and 2. In further elaboration of the invention, guiding elements may be provided at opposing outer sides of the document steering arrangement 14 at least partly along the document inserting path 8. The guiding elements may align the document 2 just before reaching the document steering arrangement 14, for instance by displacing the document in transversal direction with respect to the document inserting path 8.

According to a further aspect of the invention, the inserting apparatus 1 may be provided with lifting means 25 that are arranged to lift the document steering arrangement 14 with respect to the document inserting path 8 (see FIGS. 2 and 4). The lifting means 25 may comprise a lifting element 26, in this example the leaf spring 18, and an actuator 27 provided at the end of the leaf spring 18 facing away from the document steering arrangement 14. The actuator 27 comprises an operating lever 28 that is operated by the pushing finger 11 upon passing said lever 28. Lifting of the document 2 may be advantageous in case there is a risk that the document 2 may buckle down between the pushing fingers 11 and the document steering arrangement 14, for instance in case the document has a relatively large length. In the shown example, the actuator 27 comprises a second operating lever 29 arranged such with respect to the first operating lever 28 that upon displacement of the first operating lever 28 by the pushing finger 11, the second operating lever 28 is displaced to be positioned in the return path 8*b* of the pushing finger 11 (see FIG. 2). When the pushing finger 11 passes the second operating lever 29, the first operating lever 28 is displaced to return in the initial position as shown in FIG. 3. In another embodiment of the invention, buckling of the document 2 may instead or additionally be prevented by driving the document steering elements 15. In that case a sensor, such as a position sensor, may be provided in the inserting apparatus 1 that is able to detect the position of the document 2 with respect to the document steering arrangement 14. When the document reaches a predetermined position, the sensor may provide a signal that initiates driving the steering elements 15. Preferably, the steering elements 15 are driven when the document 2, or at least the downstream document side 2*f*, is positioned between the envelope 4 and the steering rollers 15. The sensor may be arranged as a detection unit 30 that is adapted to detect the position of the document 2 with respect to the envelope 4. More specifically, the detection unit 30 may detect the position of the upstream document side 2*e* with respect to the crease line 7 of the envelope 4 next to detecting the downstream document side 2*f*. The detection unit 30 may comprise an indicator 31 (see FIGS. 2 and 5) that is rotatably arranged to the document steering arrangement 14. The indicator 31 is adapted to rotate during passing of the document 2 as can be clearly seen in FIG. 5. The detection unit 30 further comprises a sensor 32 that is adapted to determine a rotational displacement of the indicator 31. The indicator 31 may be biased in a first position, for instance by means of a torsion spring, wherein part 31*a* of the indicator 31 extends in the document inserting path 8 such that when a document 2 passes the indicator 31, the extending part 31*a* is rotated in the inserting direction Ri. After the upstream side 2*e* of the document 2 has passed the indicator 31, the indicator 31 returns in its initial position. The sensor 32 may, for instance, be a light sensitive cell. By providing the detection unit 30, it may be easily determined if the document 2 is completely inserted in the envelope 4. In different embodiments of the invention, also other suitable indicators 31 and sensors 32 may be used to determine the position of the document 2. In an alternative embodiment (not shown), the envelop holder 3 may for instance be arranged such that in use, thus in case an envelope 4 is received in the envelope holder, an electrical conductive element is located adjacent the crease line 7 of the envelope 4. Preferably, the electrical conductive element extends at least partly along said crease line 7 at a side of the envelope 4 facing the document steering arrangement 14. The document steering arrangement 14 may be provided with a further electrical conductive element, for instance being an end part of the leaf spring 18 facing the electrical conductive element of the envelope holder 3. When the document 2 has been inserted into the envelope 4 in a correct way, both electrical conductive elements will be in mutual contact, such that can be determined if the document is inserted properly.

Subsequently, the envelope 4 may be discharged from the envelope holder 3 and may be closed. The envelope 4 comprising the document 2 may be discharged by means of rollers brought in a nipping engagement or for instance by the pushing fingers 11 that continue to push the document 2 and the surrounding envelope 4 in the inserting direction Ri along a discharge path (not shown).

In the foregoing specification, the invention has been described with reference to specific examples of embodiments of the invention. It will, however, be evident that various modifications and changes may be made therein without departing from the broader spirit and scope of the invention as set forth in the appended claims. For instance, the inserting apparatus 1 may be arranged in a document processing system in between different apparatuses. The inserting apparatus 1 may be suitable to insert different kinds of documents with different kinds of dimensions into different kinds of envelopes with different kinds of dimensions. Furthermore, the document displacement arrangement and the envelope holder may have different constructions. However, other modifications, variations and alternatives are also possible. The specifications, drawings and examples are, accordingly, to be regarded in an illustrative rather than in a restrictive sense.

In the claims, any reference signs placed between parentheses shall not be construed as limiting the claim. The word 'comprising' does not exclude the presence of other features or steps then those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage.

The invention claimed is:

1. An inserting apparatus for inserting documents into envelopes, the apparatus comprising:

an envelope holder for holding an envelope at least in a document inserting position, wherein a first upstream end of the envelope is in an open position for receiving said document;

a document inserting path arranged upstream of the envelope holder for feeding at least one document to the envelope in a document inserting direction;

a document displacement arrangement for displacing the document at least along the document inserting path into the envelope;

wherein the document displacement arrangement comprises at least one displacement element that is adapted to push the document into the envelope, wherein the apparatus further comprises a document steering arrangement arranged upstream of the envelope holder such that the document steering arrangement is opposed to an envelope crease line provided between an envelope flap and an envelope body of the envelope in the document inserting position, which arrangement comprises at least two steering elements that are spaced apart along a steering arrangement central axis that is aligned with the envelope crease line of the envelope in the document inserting position, which steering elements are interconnected such that said respective steering elements are rotatable about the central axis in a similar direction with a similar speed during a similar time interval.

2. Inserting apparatus according to claim 1, wherein the steering arrangement comprises an axle extending along the steering arrangement central axis and at least two steering element forming rollers connected at mutual distance to said axle, wherein said axle is substantially aligned with said envelop crease line.

3. Inserting apparatus according to claim 1, wherein the document displacement arrangement comprises at least two pushing fingers forming the at least one displacement element, which pushing fingers are spaced apart and arranged transversely with respect to the document inserting path.

4. Inserting apparatus according to claim 3, wherein a distance between the respective steering elements is smaller than a distance between the respective pushing fingers such that the steering elements are positioned between the inserting fingers in a direction substantially perpendicular to the document inserting path.

5. Inserting apparatus according to claim 1, wherein the respective steering elements have a diameter of approximately between 20-30 mm.

6. Inserting apparatus according to claim 1, wherein the document steering arrangement is positioned such, a press-on force of approximately 0.25-1 Newton is applied to the envelope in the document inserting position, at least to the envelope crease line, by the document steering arrangement.

7. Inserting apparatus according to claim 1, wherein the inserting apparatus comprises lifting means arranged such that the document steering arrangement is liftable with respect to the document inserting path.

8. Inserting apparatus according to claim 7, wherein the lifting means comprise a lifting element coupled to the document steering arrangement and to an actuator that actuates the lifting element upon passing of document.

9. Inserting apparatus according to claim 8, wherein the lifting element is arranged to apply a press-on force to the envelope.

10. Inserting apparatus according to claim 8, wherein the lifting element is a leaf spring.

11. Inserting apparatus according to claim 8, wherein the actuator is operable in reaction to a passing displacement element.

12. Inserting apparatus according to claim 1, wherein the document steering elements are drivable in reaction to a signal from a sensor arranged in the apparatus for detecting a document position, in order to actively rotate the respective steering elements.

13. Inserting apparatus according to claim 12, wherein the sensor is a position sensor.

14. Inserting apparatus according to claim 1, wherein the apparatus comprises a detection unit to detect the position of the document with respect to the envelope.

15. Inserting apparatus according to claim 14, wherein the detection unit comprises an indicator rotatably arranged to the document steering arrangement and adapted to rotate during passing of a document and a sensor adapted to determine a displacement of the indicator.

16. Inserting apparatus according to claim 1, wherein the inserting apparatus comprises an envelope opening device for opening a throat of the envelope to bring the envelope in the open position to receive the at least one document.

17. Inserting apparatus according to claim 16, wherein the envelope opening device comprises at least one suction cylinder arranged to displace a first envelope part enclosing the inner space in a direction substantially away from the opposing second envelope part, and at least one hook element mechanically coupled to the suction cylinder and arranged to be inserted into the inner space of the envelope after displacement of the first envelope part to hold the envelope in the open position.

* * * * *